US009147387B2

(12) United States Patent
Wolf et al.

(10) Patent No.: US 9,147,387 B2
(45) Date of Patent: Sep. 29, 2015

(54) PICKUP ASSEMBLY FOR AN ELECTRICAL STRINGED MUSICAL INSTRUMENT

(71) Applicant: RTT Music, Inc., Kettering, OH (US)

(72) Inventors: Rick Wolf, Kettering, OH (US); Timothy Rotterman, Dayton, OH (US)

(73) Assignee: RTT MUSIC, INC., Kettering, OH (US)

( * ) Notice: Subject to any disclaimer, the term of this patent is extended or adjusted under 35 U.S.C. 154(b) by 209 days.

(21) Appl. No.: 13/950,400

(22) Filed: Jul. 25, 2013

(65) Prior Publication Data

US 2015/0027300 A1 Jan. 29, 2015

(51) Int. Cl.
*G10H 3/14* (2006.01)
*G10H 3/18* (2006.01)

(52) U.S. Cl.
CPC ..... *G10H 3/181* (2013.01)

(58) Field of Classification Search
CPC ..... G10H 3/181; G10H 3/18; G10H 3/182; G10H 1/32; G10H 3/186; G10H 2220/461; G10H 1/0555; G10H 3/00; G10H 3/12; G10H 3/22; G10H 3/14; G01R 33/46; G01R 15/14; G01R 15/142; G01R 19/2513; G01R 15/18; G01R 1/02; G01R 5/02; G01R 13/00; G01R 15/207
See application file for complete search history.

(56) References Cited

U.S. PATENT DOCUMENTS

| | | | | | |
|---|---|---|---|---|---|
| 2,145,490 | A | * | 1/1939 | Miller | 84/727 |
| 2,175,325 | A | * | 10/1939 | Sunshine | 84/727 |
| 4,133,243 | A | * | 1/1979 | DiMarzio | 84/727 |
| 4,220,069 | A | | 9/1980 | Fender | |
| 4,320,681 | A | * | 3/1982 | Altilio | 84/726 |
| 4,425,831 | A | | 1/1984 | Lipman | |
| 4,433,603 | A | | 2/1984 | Siminoff | |
| 4,442,749 | A | * | 4/1984 | DiMarzio et al. | 84/728 |
| 4,854,210 | A | | 8/1989 | Palazzolo | |
| 4,872,386 | A | | 10/1989 | Betticare | |
| 5,029,511 | A | | 7/1991 | Rosendahl | |
| 5,168,117 | A | | 12/1992 | Anderson | |
| 5,221,805 | A | | 6/1993 | Lace | |
| 5,252,777 | A | | 10/1993 | Allen | |
| 5,637,823 | A | | 6/1997 | Dodge | |
| 5,811,710 | A | * | 9/1998 | Blucher et al. | 84/728 |
| 5,894,101 | A | * | 4/1999 | Damm | 84/728 |
| 5,949,014 | A | | 9/1999 | Rashak et al. | |
| 6,103,966 | A | * | 8/2000 | Kinman | 84/728 |
| 6,111,184 | A | | 8/2000 | Cloud et al. | |
| 6,253,654 | B1 | | 7/2001 | Mercurio | |
| 6,291,759 | B1 | * | 9/2001 | Turner | 84/726 |
| 6,372,976 | B2 | * | 4/2002 | Damm | 84/723 |
| 8,178,774 | B2 | | 5/2012 | Salehi | |
| 8,415,551 | B1 | | 4/2013 | Dixon | |
| 2005/0162247 | A1 | * | 7/2005 | Beller | 335/179 |
| 2012/0103170 | A1 | * | 5/2012 | Kinman | 84/726 |
| 2012/0210847 | A1 | * | 8/2012 | Adair et al. | 84/726 |
| 2012/0210848 | A1 | | 8/2012 | Yamanaka | |
| 2013/0327202 | A1 | * | 12/2013 | Mills | 84/726 |
| 2014/0245877 | A1 | * | 9/2014 | Gelvin | 84/727 |
| 2015/0027300 | A1 | * | 1/2015 | Wolf et al. | 84/726 |

* cited by examiner

*Primary Examiner* — Marlon Fletcher
(74) *Attorney, Agent, or Firm* — Thomas E. Lees, LLC

(57) ABSTRACT

A pickup for an electrical, stringed musical instrument includes a first assembly and a second assembly. The first assembly includes a base plate, a pole that extends upward from the base plate and a coil of wire wrapped around the pole above the base plate. The second assembly includes a housing that has a fastening feature that allows the second assembly to be user attachable and detachable from the first assembly independently of any electrical connections made by the first assembly. The second assembly also includes a magnet seated within the housing. The pickup is further constructed so that the second assembly readily attaches and detaches to the first assembly such that when attached, the pole of the first assembly is in magnetic cooperation with the magnet of the second assembly.

19 Claims, 10 Drawing Sheets

PICKUP ASSEMBLY FOR AN ELECTRICAL STRINGED MUSICAL INSTRUMENT

BACKGROUND

The present disclosure relates in general to a pickup for a stringed musical instrument, and more particularly to a pickup assembly for a stringed musical instrument that allows for the convenient and ready change and/or adjustment of the electrical characteristics of the pickup.

A typical electrical, stringed musical instrument such as an electric guitar or electric bass includes body, a neck extending from the body, and a headstock situated at the end of the neck. A set of strings span between a bridge located on the body and a nut located on the neck adjacent to the headstock. When strummed, plucked, picked or otherwise stroked, the strings vibrate producing sound. However, the acoustical output of the vibrating strings may not be loud enough for an intended application. As such, the instrument typically includes one or more electromagnetic pickups. The pickups convert the vibration of the strings into a representative electrical signal that can be coupled to an amplifier to produce an appropriate level of sound from the instrument.

BRIEF SUMMARY

According to aspects of the present disclosure, a pickup for an electrical, stringed musical instrument is provided. The pickup includes in general, a first assembly and a second assembly. The first assembly includes a base plate, a pole that extends from the base plate and a coil of wire having a first coil end and a second coil end, where the coil of wire is wrapped around the pole extending from the base plate. The first assembly also includes a first lead wire attached to the first coil end and a second lead wire attached to the second coil end. The second assembly includes a housing having a fastening feature that allows the second assembly to be user attachable and detachable from the first assembly independently of any electrical connections made by the first lead wire and the second lead wire. Additionally, the second assembly includes a magnet seated within the housing. The pickup is further constructed so that the second assembly readily attaches to and detaches from the first assembly such that when attached, the pole of the first assembly is in magnetic cooperation with the magnet of the second assembly.

According to further aspects of the present disclosure, a pickup for an electrical, stringed musical instrument is provided. The pickup comprises a first assembly and a second assembly. The first assembly has a base plate and a pole that extends from the base plate. The first assembly also includes a coil of wire having a first coil end and a second coil end, where the coil of wire is wrapped around the pole above the base plate. A first lead wire is attached to the first coil end, and a second lead wire is attached to the second coil end. The second assembly has a housing having a magnet well and a magnet seated within the magnet well of the housing. The pickup also comprises a spring positioned between the first assembly and the second assembly. The pickup also comprises an adjustment device that couples the first assembly to the second assembly and cooperates with the spring such that adjustment of the adjustment device moves the second assembly relative to the first assembly. This has the effect of moving the magnet relative to the pole. In this regard, the pole of the first assembly is in magnetic cooperation with the magnet of the second assembly throughout a range of adjustment of the adjustment device.

For example, the adjustment device may comprise a first bolt that threadably couples the first assembly to the second assembly and the spring may correspondingly comprise a first structure that sits over the first bolt between the first assembly and the second assembly, e.g., a wire spring, elastomeric spring, etc. Further, the pickup may comprise a second bolt that threadably couples the first assembly to the second assembly (e.g., towards an end opposite the first bolt) and a second spring that sits over the second bolt between the first assembly and the second assembly.

Moreover, the ability of an adjustable magnet can be combined with the ability to remove and replace the second assembly relative to the first assembly. In this regard, the pickup may comprise a fastening feature that allows the second assembly to be user attachable and detachable from the first assembly independently of any electrical connections made by the first lead wire and the second lead wire. For instance, the second assembly may comprise a magnet well and a pair of flanges that each flank the magnet well as described more fully herein.

DETAILED DESCRIPTION

According to various aspects of the present disclosure, a pickup for an electrical, stringed musical instrument includes a changeable magnet assembly. The changeable magnet assembly facilitates changing the magnetic properties of the pickup without disturbing the electrical wiring of the pickup to other electronics in a corresponding instrument. For instance, the properties of the pickup installed in an instrument can be altered by exchanging a first changeable magnet assembly with a second changeable magnet assembly, where the second changeable magnet assembly includes a magnet having different properties compared to the magnet of the first changeable magnet assembly. Changing the magnet can result in moderate to significant changes to the response, output, harmonics and sound of the pickup in an instrument. Moreover, the changeover may be implemented without disconnecting any electrical wiring of the pickup to the instrument. That is, the changeover can optionally be accomplished without removing the first assembly from an instrument to which the pickup is installed.

According to further aspects of the present disclosure, a pickup for an electrical, stringed musical instrument is provided, which includes an adjustable magnet assembly that allows user adjustment of the magnet position within the pickup relative to a pole of the pickup. The ability to adjust the magnet position relative to the pole position allows a user to make "on-the-fly" adjustments to the performance of the pickup. As such, pickups are provided herein, that allow for the convenient and ready change and/or adjustment of the electrical characteristics of the pickup by providing for the changeover and/or adjustment of the relationship between a pole and a magnet of the pickup, as will be described in greater detail herein.

Still further, the nature of the construction of the disclosed pickups facilitates fast and efficient construction and assembly, making the pickups herein suitable for large volume production with reduced cost and reduced parts compared to conventional pickup designs.

Figure 1:
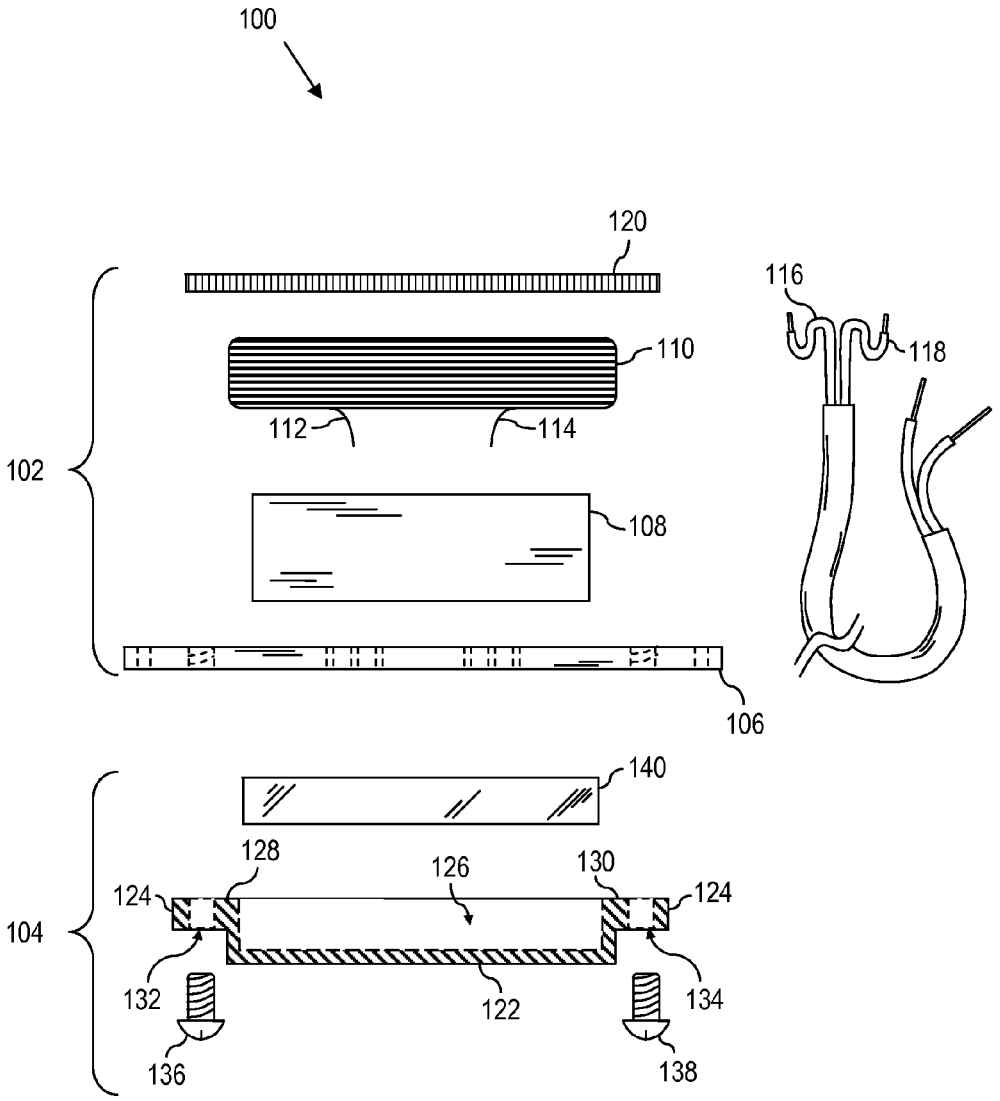
FIG. 1 is an exploded view of a pickup construction according to aspects of the present disclosure.

Two-Assembly Pickup Construction:

Referring now to the drawings and in particular to FIG. 1, an exploded view illustrates the parts of a pickup 100 for an electrical, stringed musical instrument, according to certain aspects of the present disclosure. The pickup 100 is an electromagnetic device that includes in general, a first assembly 102 and a second assembly 104. As will be described in greater detail herein, the first assembly 102 includes all of the electrical components of the pickup 100, whereas the second assembly 104 includes the magnet component(s) of the pickup 100.

The first assembly 102 includes a base plate 106 and a pole 108 that extends upward from the base plate 106. The first assembly 102 also includes a coil of wire 110 having a first coil end 112 and a second coil end 114, where the coil of wire 110 is wrapped around the pole 108, e.g., above the base plate 106. A first lead wire 116 is attached to the first coil end 112. Similarly, a second lead wire 118 is attached to the second coil end 114.

The first assembly 102 may also optionally include a top plate 120. In this regard, the coil of wire 110 is sandwiched between the base plate 106 and the top plate 120. Also, the pole 108 is seated within the coil of wire 110 and may extend up to or through the top plate 120. Additionally or alternatively, a pickup cover (not shown) or other features may be provided.

The second assembly 104 includes a housing 122 that includes a fastening feature 124 that allows the second assembly 104 to be user attachable to the first assembly 102 and user detachable from the first assembly 102. For instance, as illustrated, the housing 122 includes a magnet well 126. In this regard, the fastening feature 124 is implemented by a pair of flanges including a first flange 128 extending from a first end of the magnet well 126 and a second flange 130 extending from an end of the magnet well 126 opposite the first flange 128. Thus, the first flange 128 and the second flange 130 flank either side of the magnet well 126.

The first flange 128 includes a first aperture 132 therethrough. Analogously, the second flange 130 includes a second aperture 134 therethrough. A first fastener 136, e.g., a bolt passes through the first aperture 132 and is threadably received in the base plate 106 of the first assembly 102. Similarly, a second fastener 138, e.g., a bolt, passes through the second aperture 134 and is threadably received in the base plate 106 of the first assembly 102. For instance, threaded holes may be machined into the base plate 106 to align with the first aperture 132 and the second aperture 134. As another example, threaded inserts can be press fit into apertures extending through the base plate 106. Thus, the first fastener 136 and the second fastener 138 can be used to removably attach the housing 122 of the second assembly 104 to the base plate 106 of the first assembly 102.

This allows for instance, the ability of a user to remove an existing second assembly 104 from a given first assembly 102, and to install a new instance of a second assembly 104 (e.g., with different magnetic properties), simply and easily with common and conventional tools. Moreover, the electrical components are contained to the first assembly 102. For instance, the first lead wire 116 and the second lead wire 118, are attached to the first assembly 102 and extend from a side thereof, such that the first lead wire 116 and the second lead wire 118 do not need to be electrically disconnected from the pickup or other electronics within a corresponding instrument in order for the second assembly 104 to be swapped out. Thus, the properties of the pickup 100 can be changed without de-soldering the wiring to the other electronics of the instrument. Thus, the first assembly 102 is independent from the second assembly 104, allowing instances of the first assembly 102 to be freely mixed and matched with instances of the second assembly 104.

According to alternative aspects of the present disclosure, the second assembly 104 need not be user removable from the first assembly 102 once assembled. Such may be desirable in a manufacturing environment where the two-component approach herein is implemented to ease manufacturing and to reduce cost to manufacture.

According to still further alternative aspects of the present disclosure, the second assembly 104 need not be user removable from the first assembly 102 where the second assembly 104 is made user-adjustable relative to the first assembly 102, examples of which are described more fully herein.

As noted above, the second assembly 104 attaches and detaches from the first assembly 102 independently of any electrical connections made by the first lead wire 116 and the second lead wire 118. This allows the first assembly 102 and the second assembly 104 to be separately manufactured. Moreover, the above-structure allows the first assembly 102 to be coupled to the second assembly 104 any time before, during, or after the first assembly 102 of the pickup 100 has been installed in an instrument. For instance, where the pickup 100 attaches to a pick guard of an instrument (not shown), the second assembly 104 can be connected to the first assembly 102 even after the first assembly 102 is installed in the pick guard.

Although illustrated as using fasteners, e.g., bolts, the first assembly 102 can attach and detach from the second assembly 104 using other approaches, e.g., bands, clips, snaps, hook and loop fastener, magnets, etc. In certain embodiments, any approach may be utilized so long as the first assembly 102 can be user connected and separated from the second assembly 104.

A magnet 140 is seated within the housing 122. For instance, in the illustrative implementation, the magnet 140 seats in the magnet well 126. The magnet 140 can be potted, glued, or otherwise secured within the magnet well 126. Moreover, other structures may be included in the magnet well 126, such as a shim, a plate, a spacer, a well cover, etc.

The magnet 140 cooperates with the pole 108 to create a magnetic field about the pickup 100. In this regard, the second assembly 104 attaches and detaches to the first assembly 102 such that when attached, the pole 108 of the first assembly 102 is in magnetic cooperation with the magnet 140 of the second assembly 104.

When the pickup 100 is installed in a corresponding electrical stringed musical instrument, the pole 108 sits beneath the strings. The pole 108, in cooperation with the magnet 140 shapes a magnetic field that surrounds the pickup 100. The strings are composed of a magnetizable structure, e.g., metal such as steel, a magnetizable alloy or other structure that can interact with the magnetic field of the pickup 100. When the strings vibrate, the vibration of the string causes a corresponding change in the magnetic field about the pickup 100. This change in the magnetic field induces a corresponding electrical current in the coil of wire 110. That electrical current is output through a corresponding instrument and optional instrument electronics to an amplifier.

Example Pickup Component Configurations

The base plate 106 and the top plate 120 may be implemented as separate pieces, and thus define bobbin plates. In general, the base plate 106 and the top plate 120 may be any number of nonconductive materials, e.g., plastic, butyrate, a semi-rigid fibrous material, etc. Where the base plate 106 and the top plate 120 are implemented as separate pieces, the coil of wire 110 may wrap directly around the pole 108. Here, the top plate 120 sits over the base plate 106 such that the pole 108 extends through the top plate 120 and the coil of wire 110 is between the top plate 120 and the base plate 106.

Alternatively, the base plate 106 and the top plate 120 may be integral, e.g., implemented as a non-conductive bobbin that the coil of wire 110 wraps around. In this implementation, the pole 108 passes through the bobbin. Whether the base plate 106 and top plate 120 are separate pieces or a single bobbin depends upon the pickup style. For instance, many single coil designs do not use a bobbin. Comparatively, if the pickup 100 is being constructed as a "P-90" style or traditional "humbucker" style, then a bobbin is typically used, but is not required.

As used herein, the term "pole" 108 encompasses a single element, a combination of elements, an assembly of elements(s) and other structure(s), etc. As a few non-limiting but illustrative examples, the pole 108 may be constructed from a ferrous material (e.g., iron or steel being the most common), a ferromagnetic material, a magnetic material, an otherwise magnetizable material, or any other suitable material that contributes to the ability of the pickup to create a magnetic field or otherwise sense a change in the magnetic field.

Moreover, the pole 108 can be constructed in any suitable configuration. For instance, the pole 108 may be a blade, a set of individual slugs, a set of individual threaded pole pieces, any combination of blades, slugs and screws, etc. As used herein, the term "slug" with regard to the pole 108 includes a generally cylindrical shape, a cube or cuboid shape, a spherical shape, an irregular shape or other desired configuration that can cooperate with the magnet 140 to create a magnetic field about the pickup 100.

As a few illustrative examples, the pole 108 may comprise at least one blade (e.g., a generally cuboid shaped bar that is dimensioned to span all strings of a corresponding instrument to which the corresponding pickup is intended). The pole 108 may also be implemented as a set of slugs (e.g., one or more slugs dimensioned and spaced within the first assembly 102 to generally align under each string of a corresponding instrument). Still further, the pole 108 may be implemented as a set of slugs where one slug is dimensioned and spaced within the first assembly 102 to generally align under two or more strings of a corresponding instrument. The above-examples are non-limiting and other elements and configurations can be used as the pole 108.

As used herein, the term "magnet" 140 can in practice, be a single magnet, a combination of individual magnets, an assembly of magnet(s) and non-magnetic structure(s), etc. As a few non-limiting but illustrative examples, the magnet 140 may comprise a single magnet, e.g., a permanent magnet such as a ceramic magnet, a magnet of Alnico 2, a magnet of Alnico 5, or other magnet types. As a further example, the magnet 140 may be implemented as a set (e.g., one or more) of magnetic slug(s) where the slugs can be the same or different magnet type. As used herein, the term "slug" with regard to the magnet 140 includes a generally cylindrical shape, a cube or cuboid shape, a spherical shape, an irregular shape or other desired configuration that allows one or more magnets to be placed in the magnet well 126 or otherwise arranged such that the magnet well 126 holds the magnet 140. For instance, if the pole 108 is individual steel slugs, the magnet 140 can be a set of magnetic slugs, where one or more magnetic slugs align with each pole slug. Alternatively, one magnetic slug can align with one or more pole slugs, one pole slug can align with one or more magnet slugs, etc. As yet a further example, the magnet 140 can include non-magnetic structure(s) such as two individual magnets that sandwich a steel bar, a combination of one or more magnet(s) and one or more structure(s), etc.

The coil of wire 110 can in practice be a single continuous coated/insulated wire. Alternatively, the coil of wire 110 may be constructed from the series connection of one or more wire types. The wire is typically fine, e.g., on the order of 42 gauge or 43 gauge. However, any practical wire thickness (or thicknesses) can be used, depending upon the desired electrical properties of the pickup 100. Moreover, the wire can be constructed of any suitable material, e.g., copper, silver, gold, combinations thereof, etc. The number of turns of wire will depend upon the desired electrical characteristics of the pickup. However, typical pickups utilize several thousand turns of wire.

Once the first lead wire 116 and the second lead wire 118 are attached to the pickup 100, the pickup 100 can further be processed to secure the coil of wire 110. For instance, a length of wire (e.g., the same wire used to build the coil of wire 110) can optionally be wrapped around the coil of wire 110 so as to cover the entire coil, thus serving as a protective element. The wrapping of wire may also be utilized as a design element or for other decorative purposes. The coil of wire 110 can be protected by other and/or alternative protective elements as well. Examples of other protective elements include string, tape, cloth, etc.

The entire first assembly 102 of the pickup 100 may be "potted", so as to provide a potted treatment about the coil of wire. For instance, the pickup 100 may be treated in a melted mixture of paraffin, wax, chemical polymers or combinations thereof. This helps prevent microphonics in the pickup by preventing the wire in the coil of wire 110 from vibrating. In an illustrative implementation, the pickup is treated but is not vacuum chambered. Alternatively, the pickup 100 may be vacuum chambered.

Figure 2:
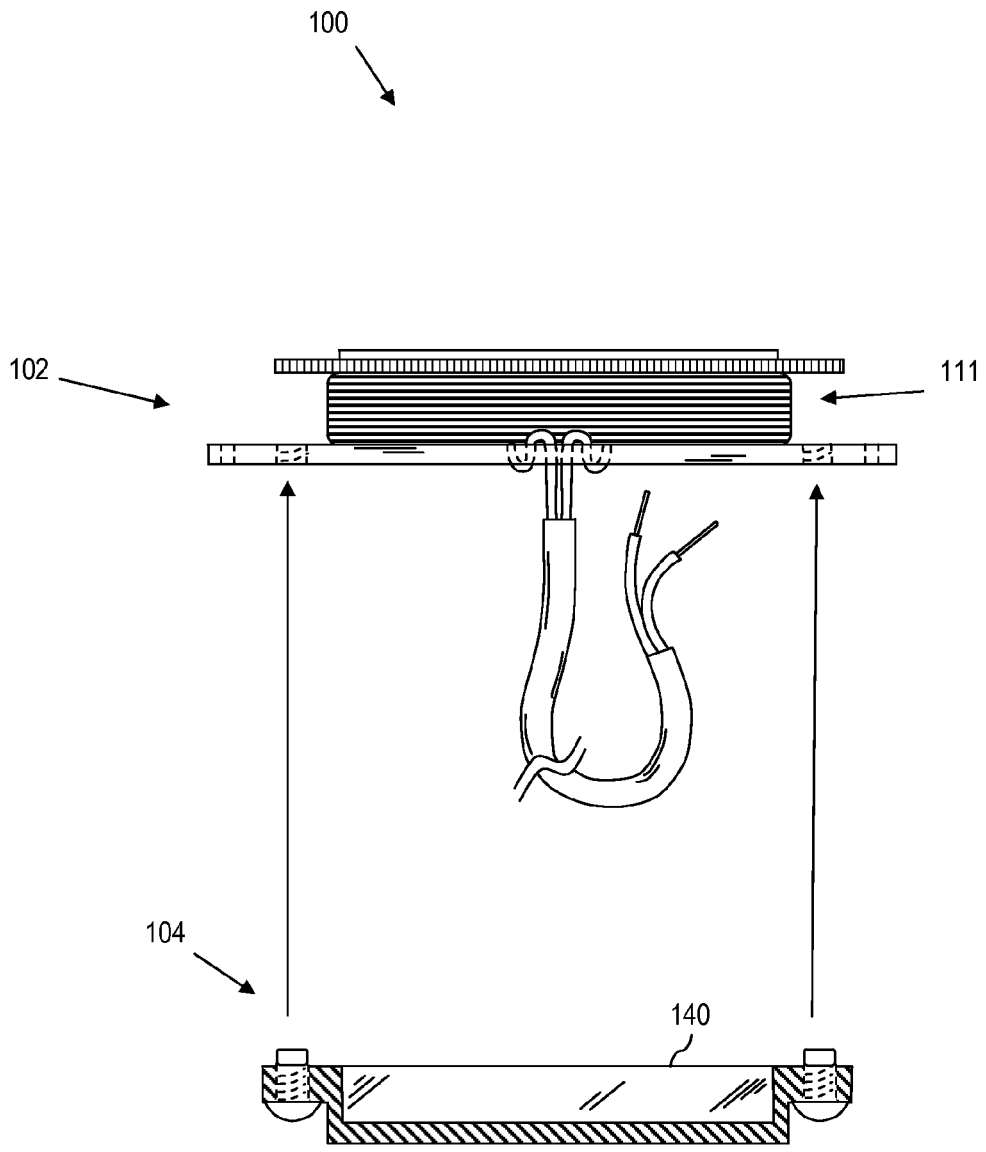
FIG. 2 is a side view of the pickup of FIG. 1 in a disassembled state, according to various aspects of the present disclosure.

Pickup Assembly:

Referring to FIG. 2, the pickup 100 of FIG. 1 is illustrated in a disassembled state. For instance, keeping with the above example, a user may have removed the two bolts that secure the second assembly 104 to the first assembly 102.

FIG. 2 also illustrates a wrapping 111 that is provided as an outer layer over the coil of wire. For instance, as noted above, the wrapping 111 can comprise a length of wire wrapped around the coil of wire 110. Alternatively, the wrapping 111 can be cloth, tape, etc.

Figure 3:
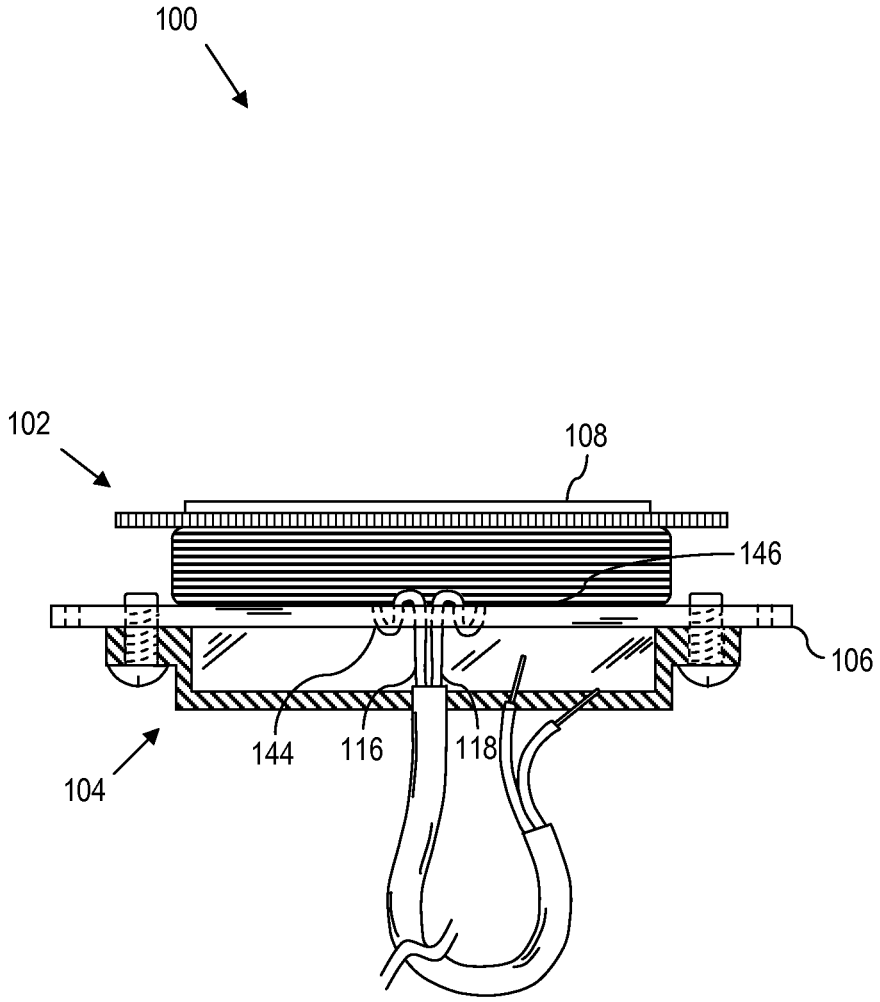
FIG. 3 is a side view of a pickup in an assembled state, according to various aspects of the present disclosure.

Referring to FIG. 3, the pickup 100 is illustrated in an assembled state where the second assembly 104 is secured to the first assembly 102. For instance, a user could screw the second assembly 104 to the first assembly 102 as described more fully herein.

As illustrated in FIG. 3, the base plate 106 further includes at least a first strain relief hole 144 and at least a second strain relief hole 146. For instance, as illustrated, there are a total of six strain relief holes (three holes per wire). The first lead wire 116 passes through the first strain relief hole 144. The first lead wire 116 may optionally snake up through an adjacent, second hole, then feed down a third hole. Similarly, the second lead wire 118 passes through the second strain relief hole 146. In an analogous manner, the second lead wire 118 may optionally snake up through an adjacent, second hole, then feed down a third hole. As such, any normal tugging on the first lead wire 116 and/or the second lead wire 118 will not cause strain on the connection of the lead wires to the corresponding coil wire ends.

Figure 4:
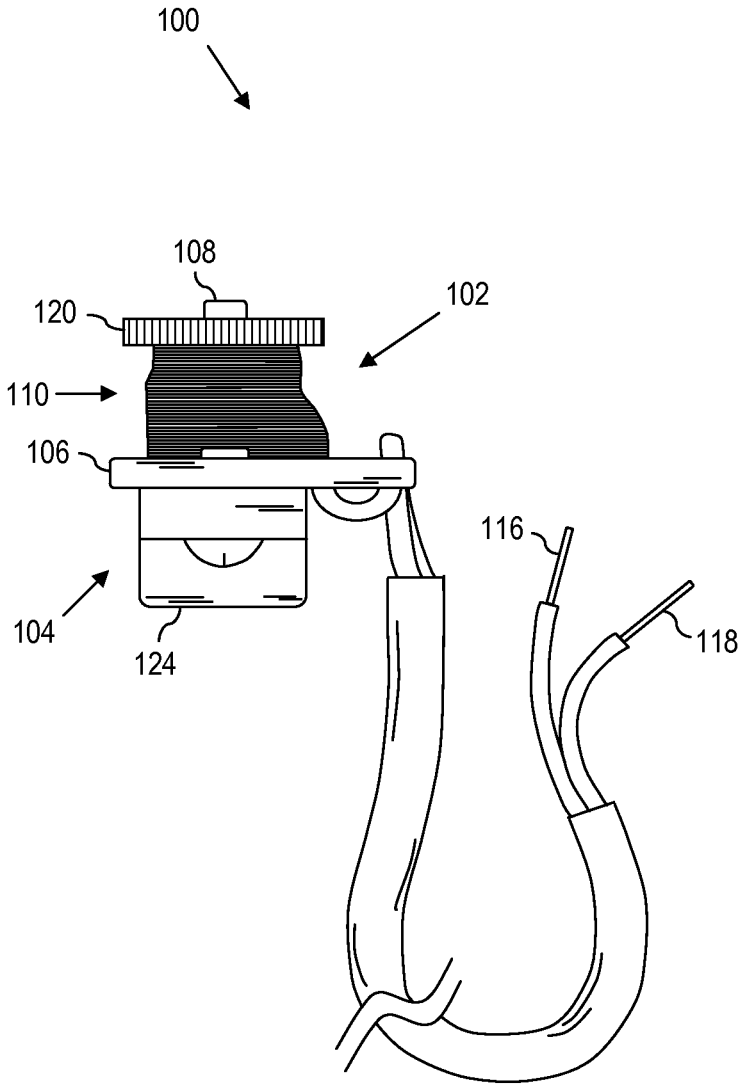
FIG. 4 is an end view of the pickup of FIG. 2.

Referring to FIG. 4, the pickup 100 of FIG. 1-FIG. 3 is illustrated in a side view to illustrate an embodiment where the base plate 106 of the first assembly 102 is wider than the housing 122 of the second assembly 104 to accommodate the strain relief for the first lead wire 116 and the second lead wire 118. In this illustrative implementation, the pole 108 extends from the top plate 120. However, in alternative implementations, the pole 108 can be flush with the top plate 120.

Figure 5:
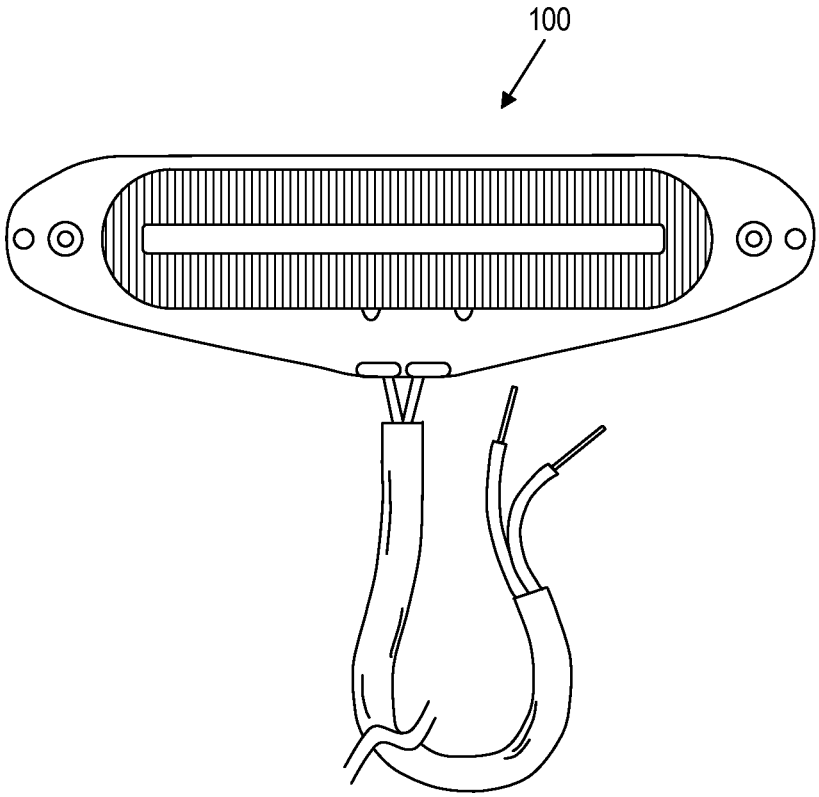
FIG. 5 is a top view of the pickup of FIG. 2.

Referring to FIG. 5, a top view of the pickup 100 (of FIGS. 1-4) is illustrated.

Adjustable Magnet Assembly:

Referring to the FIGURES generally, the magnet 140 typically makes direct physical contact with the pole 108 (e.g., the blade or each slug, screw, etc.). However, such need not be the case. In this regard, adjustability of the magnet relative to the pole 108 can be used to further alter the electrical/magnetic properties of the pickup.

For instance, according to an illustrative implementation, the first assembly 102 further comprises a field-adjusting control that is user adjustable such that when the first assembly 102 is assembled with the second assembly 104, adjustment of the field adjusting control adjusts the distance of the magnet 140 from the pole 108. For instance, as will be described in greater detail below, the field-adjusting control includes a first threaded device that extends through the base plate 106 proximate to a first end and a second threaded device that extends through the base plate 106 proximate to a second end opposite the first end. In this regard, adjustment of the first threaded device selectively moves a first end of the magnet 140 relative to the pole 108 such that magnetic coupling remains. Likewise, adjustment of the second threaded device selectively moves a second end of the magnet 140 relative to the pole 108 such that magnetic coupling remains.

Figure 6:
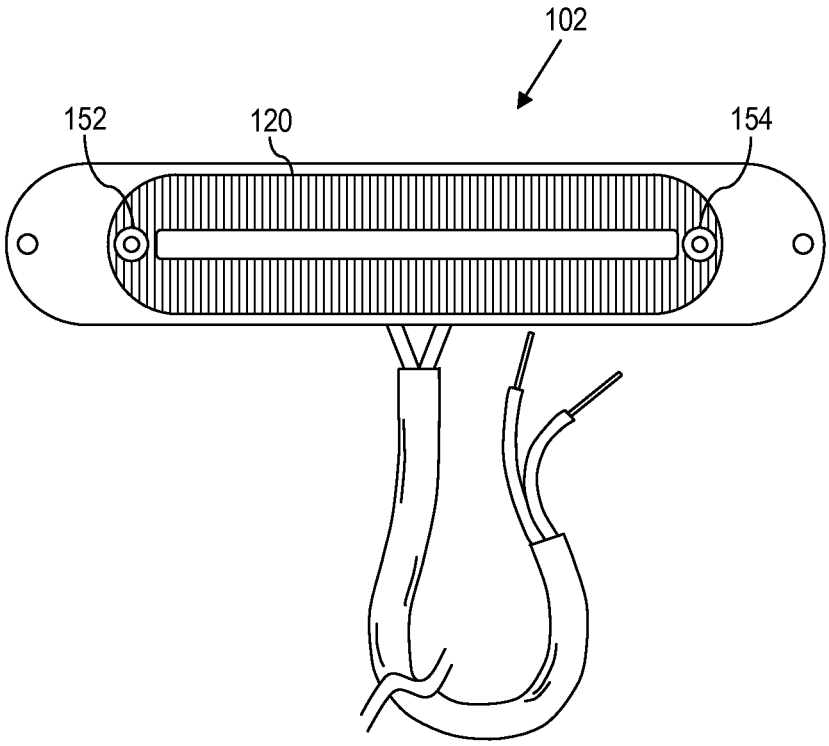
FIG. 6 is a top view of a pickup having a field adjusting control according to aspects of the present disclosure.

Referring to FIG. 6, a pickup 100 can include a field adjusting control according to an aspect of the present disclosure (alternative configurations are described later). As illustrated, the top plate 120 includes a pair of adjustment ports, including a first adjustment port 152 and a second adjustment port 154. The pickup of FIG. 6 also illustrates an embodiment where the base plate 106 of the first assembly 102 has dimensions that are similar to the dimensions of the housing 122 of the second assembly 104. Here, the strain relief for the first lead wire 116 and the second lead wire 118 is concealed by the top plate 120 when looking "top down" thus allowing a smaller pickup profile relative to the configuration illustrated in FIG. 5.

Figure 7:
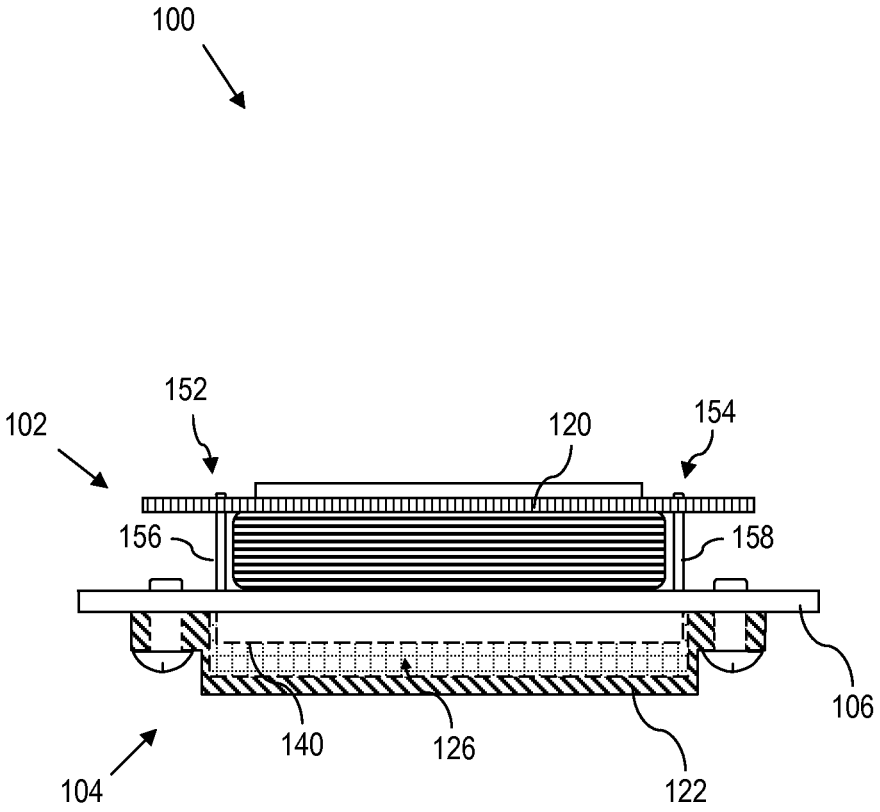
FIG. 7 is a side view of the pickup of FIG. 6 with a magnet in a first position according to aspects of the present disclosure.

Referring to FIG. 7, a first threaded device 156 passes through the first adjustment port 152 so as to extend through the top plate 120, the base plate 106 and into the magnet well 126 where the magnet 140 resides. Similarly, a second threaded device 158 passes through the second adjustment port 154 so as to extend through the top plate 120, the base plate 106 and into the magnet well 126 where the magnet 140 resides. For instance, as illustrated, the first threaded device 156 extends through the base plate 106 proximate to a first end thereof. Likewise, the second threaded device 158 extends through the base plate 106 proximate to a second end opposite the first end.

Normally, the magnet 140 is in intimate (i.e., direct physical) contact with the pole 108. Alternatively, the magnet 140 is within an extremely short proximity to the pole 108. However, the first threaded device 156 can be threaded downward so as to urge against a section of the magnet 140 as illustrated (in an alternative example, the first threaded device can urge against the magnet housing 122), thus moving at least a portion of the magnet 140 from intimate (i.e., direct physical) contact with the pole 108. Likewise, the second threaded device 158 can be threaded downward so as to urge against a section of the magnet 140 (or alternatively, the magnet housing 122) thus moving at least a portion of the magnet 140 from intimate (i.e., direct physical or otherwise close proximate) contact with the pole 108. This adjustability can be used to change for instance, the response of the pickup to achieve greater impact on the treble-side strings or bass-side strings of a corresponding instrument, depending upon how the field adjusting control is operated.

Figure 8:
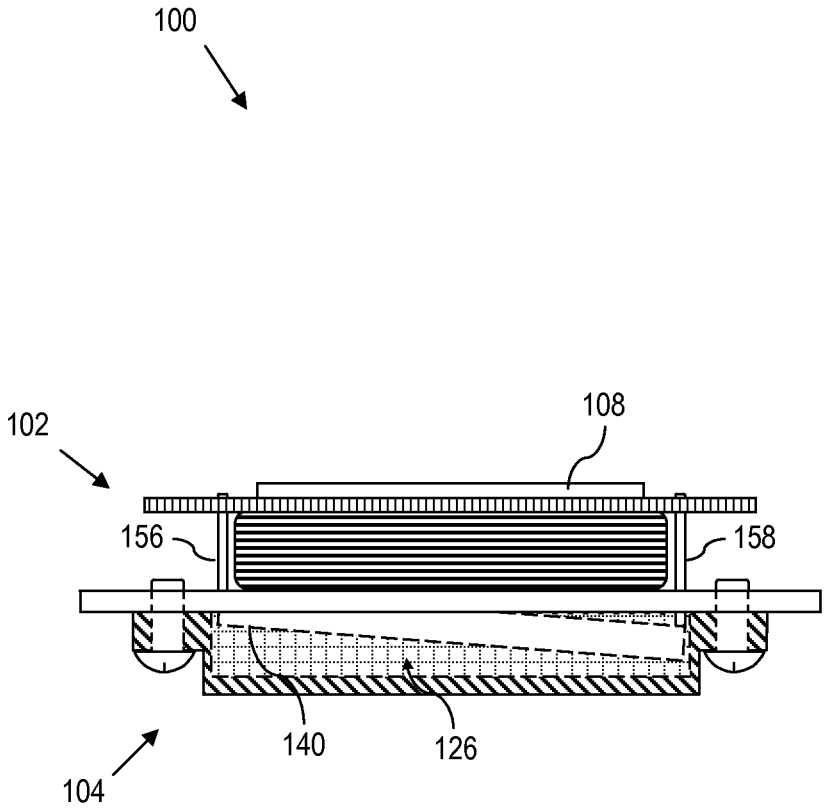
FIG. 8 is a side view of the pickup of FIG. 6 with the magnet adjusted to a second position according to aspects of the present disclosure.

Referring to FIG. 8, the magnet 140 has been adjusted such that a distance from the magnet 140 to the pole 108 is non-uniform across the length of the pole 108. For instance, as illustrated, the magnet 140 is angled downward relative to the pole 108 such that the right side (as seen in the FIGURE) of the magnet 140 is further from the pole 108 than the left side (as seen in the FIGURE) of the magnet.

Figure 9:
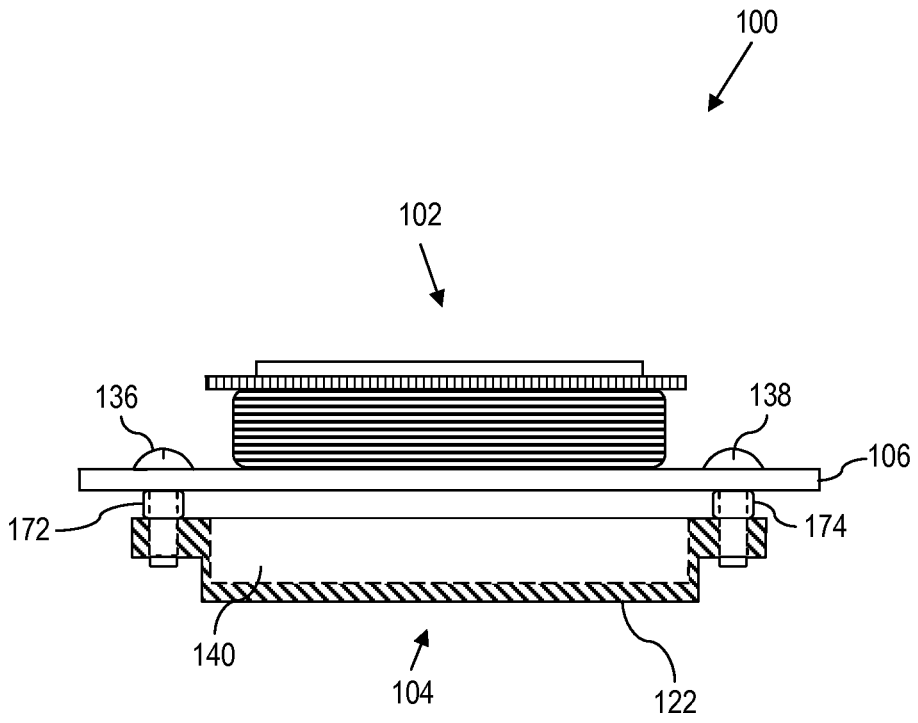
FIG. 9 is a side view of a pickup with an adjustable magnet housing in a first position according to further aspects of the present disclosure.

Referring to FIG. 9, an adjustable magnet assembly is illustrated according to still further aspects of the present disclosure. The pickup 100 is analogous the pickup 100 described in greater detail herein. However, in the illustrative example, the first fastener 136 and second fastener 138 (e.g., bolts) that are used to exchangeably secure the first assembly 102 to the second assembly 104 are "flipped" so that the bolt head is to the top of the base plate 106. Moreover, a spring is positioned between the first assembly 102 and the second assembly 104. This allows a user to adjust the position of the magnet housing 122 without disassembling the instrument or the pickup 100.

As illustrated, a first spring 172 (a first elastomeric sleeve) separates the base plate 106 of the first assembly 102 from the housing 122 of the second assembly 104 on a first side thereof. Likewise, a second spring 174 (a second elastomeric sleeve) separates the base plate 106 of the first assembly 102 from the housing 122 of the second assembly 104 on a second side opposite the first side. The springs 172, 174 can comprise an elastomeric structure, e.g., tube, sleeve etc. The springs 172, 174 may also comprise a wire spring, or other structure that serves as a spacer that can be compressed, contract or otherwise urges against the second assembly 104 as the associated bolt is tightened.

Figure 10:
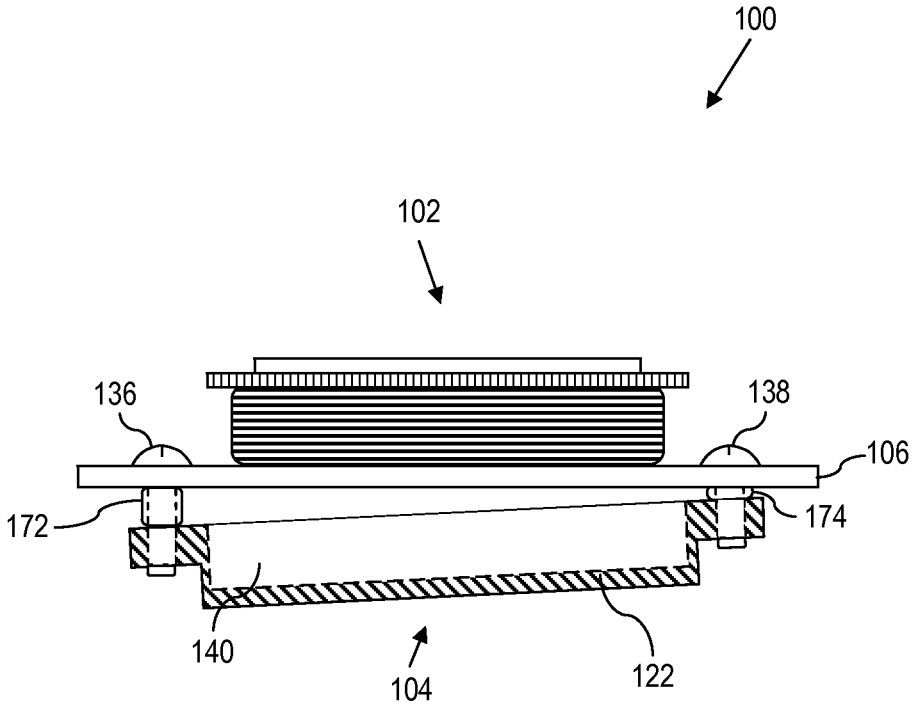
FIG. 10 is a side view of the pickup of FIG. 9 with the magnet housing adjusted to a second position different from the first position, according to further aspects of the present disclosure.

Referring to FIG. 10, the magnet housing 122 has been adjusted so as to be closer to the first assembly 102 seen to the right of the page, and correspondingly further away from the first assembly 102 seen to the left of the page. In this exemplary implementation, the magnet 140 does not move relative to the housing 122. Rather, the entire second assembly 104 moves relative to the first assembly 102.

Regardless of the particular adjustment embodiment, the adjustment of the first threaded device 156 selectively moves a first end of the magnet 140 (and/or magnet housing 122) from direct contact with the pole 108 to a spaced position from the pole 108 such that magnetic coupling remains. Likewise, the adjustment of the second threaded device 158 selectively moves a second end of the magnet 140, the housing 122, or both from direct contact with the pole 108 to a spaced position from the pole 108 such that magnetic coupling remains. By adjusting the distance of the magnet 140, the housing 122, or both from the pole 108, different sonic alterations can be achieved. The springs 172, 174 urge between the first and second assemblies 102, 104 to preserve the user-adjusted spacing.

Miscellaneous:

Traditionally, pickups provide either no adjustability, or very minor adjustability (e.g., where the pole is implemented with adjustment screws). However, for drastic changes, one is left with swapping out one pickup for another. Moreover, most pickups have exposed wires and are delicate, thus posing the risk of damage to the pickup. The prospect of damaging a pickup makes swapping pickups more difficult and time consuming. However, by utilizing the changeable magnet assembly described herein, both a manufacturer and the consumer have the benefit of being able to drastically alter the tonal qualities of a pickup, and have the ability to customize the pickup's performance. Additionally, the strain relief and protective wrapping about the coil of wire makes the pickup of the present disclosure more durable than traditional pickups, thus easing experimentation with magnet configurations to find an optimal musical result from the pickup installed in a corresponding stringed musical instrument.

By using fewer parts than traditional pickup designs, the assembly and winding process is eased and can be accomplished in shorter time and at lower cost. An additional benefit is that there are no vulnerable exposed coil wires, thus improving reliability and reducing customer returns. Moreover, the first assembly 102 and the second assembly 104 can be sold separately, mixed and matched, etc, to have numerous customization options. For instance, several models of first assembly 102 can be generated, with different wires, number of turns, winding patterns, poles, pole types, etc. Also, several different models of the second assembly 104 can be created, e.g., using different magnets 140 etc. By mixing and matching variations of the first assembly 102 with the second assembly, a vast array of options can be made available for experimentation and customization.

Also, by utilizing a top plate 120, the appearance of the pickup can be changed by changing out the top plate 120, such as when manufacturing the first assembly 102. Thus for instance, further customization can be realized by using wood, plastic, stone, or other non-conductive material to alter the aesthetics of the pickup.

Although described herein in the context of a single coil pickup, it is to be readily understood that the above-described techniques can be applied to humbucker pickups and other desired configurations that use one or more coils, sets of magnets, poles or combinations thereof.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure.

Having thus described the disclosure of the present application in detail and by reference to embodiments thereof, it will be apparent that modifications and variations are possible without departing from the scope of the disclosure defined in the appended claims.

What is claimed is:

1. A pickup for an electrical, stringed musical instrument, comprising:

a first assembly having:

a base plate;

a pole that extends from the base plate;

a coil of wire having a first coil end and a second coil end, where the coil of wire is wrapped around the pole above the base plate;

a first lead wire attached to the first coil end; and a second lead wire attached to the second coil end; and a second assembly having:

a housing that includes a fastening feature that allows the second assembly to be user attachable to, and detachable from, the first assembly independently of any electrical connections made by the first lead wire and the second lead wire; and a magnet seated within the housing;

wherein:

the second assembly attaches to and detaches from the first assembly such that when attached, the pole of the first assembly is in magnetic cooperation with the magnet of the second assembly; and the first assembly further comprising a field-adjusting control that is user adjustable such that when the first assembly is assembled with the second assembly, adjustment of the field-adjusting control adjusts a distance of the magnet from the pole.

2. The pickup of claim 1, wherein:

the base plate further comprises a first strain relief hole and a second strain relief hole;

wherein:

the first lead wire passes through the first strain relief hole and the second lead wire passes through the second strain relief hole.

3. The pickup of claim 1, wherein:

the fastening feature of the housing comprises a first aperture and a second aperture;

further comprising:

first fastener and a second fastener, where the first fastener passes through the first aperture and the second fastener passes through the second aperture to threadably attach the housing of the second assembly to the base plate of the first assembly, and to threadably detach the housing of the second assembly from the base plate of the first assembly.

4. The pickup of claim 3, wherein:

the housing of the second assembly comprises:

a magnet well that holds the magnet;

a first flange on a first end of the magnet well, the first flange having the first aperture; and a second flange on an end of the magnet well opposite the first flange, the second flange having the second aperture.

5. The pickup of claim 1, wherein:
the field-adjusting control comprises:
a first threaded device that extends through the base plate proximate to a first end; and
a second threaded device that extends through the base plate proximate to a second end opposite the first end;
where adjustment of the first threaded device selectively moves a first end of the magnet relative to the pole such that magnetic coupling remains; and
adjustment of the second threaded device selectively moves a second end of the magnet relative to the pole such that magnetic coupling remains.

6. The pickup of claim 1, wherein:
the pole comprises at least one blade.

7. The pickup of claim 1, wherein:
the first assembly further comprises a top plate that sits over the base plate such that the pole extends at least into the top plate and the coil of wire is between the top plate and the base plate.

8. The pickup of claim 1, further comprising:
protective element over the coil of wire defined by a length of wire wrapped around the coil of wire.

9. The pickup of claim 1, further comprising a potted treatment about the coil of wire.

10. A pickup for an electrical, stringed musical instrument, comprising:
a first assembly having:
a base plate;
a pole that extends from the base plate;
a coil of wire having a first coil end and a second coil end, where the coil of wire is wrapped around the pole above the base plate;
a first lead wire attached to the first coil end; and
a second lead wire attached to the second coil end; and
a second assembly having:
a housing having a magnet well; and
a magnet seated within the magnet well of the housing;
a spring positioned between the first assembly and the second assembly; and
an adjustment device that couples the first assembly to the second assembly and cooperates with the spring such that adjustment of the adjustment device moves the second assembly relative to the first assembly;
wherein:
the pole of the first assembly is in magnetic cooperation with the magnet of the second assembly throughout a range of adjustment of the adjustment device.

11. The pickup of claim 10, wherein:
the adjustment device comprises a first bolt that threadably couples the first assembly to the second assembly; and
the spring comprises a first elastomeric sleeve that sits over the first bolt between the first assembly and the second assembly.

12. The pickup of claim 11 further comprising:
a second bolt that threadably couples the first assembly to the second assembly towards an end opposite the first bolt; and
a second elastomeric sleeve that sits over the second bolt between the first assembly and the second assembly.

13. The pickup of claim 10, further comprising:
a fastening feature that allows the second assembly to be user attachable and detachable from the first assembly independently of any electrical connections made by the first lead wire and the second lead wire.

14. The pickup of claim 13, wherein:
the fastening feature of the housing comprises a first aperture and a second aperture;
further comprising:
first fastener and a second fastener, where the first fastener passes through the first aperture and the second fastener passes through the second aperture to threadably attach the housing of the second assembly to the base plate of the first assembly, and to threadably detach the housing of the second assembly from the base plate of the first assembly.

15. The pickup of claim 14, wherein:
the housing of the second assembly comprises:
a first flange on a first end of the magnet well, the first flange having the first aperture, the first fastener passes through the first aperture; and
a second flange on an end of the magnet well opposite the first flange, the second flange having the second aperture, the second fastener passes through the second aperture.

16. The pickup of claim 10, wherein:
the base plate further comprises a first strain relief hole and a second strain relief hole;
wherein:
the first lead wire passes through the first strain relief hole and the second lead wire passes through the second strain relief hole.

17. The pickup of claim 10, wherein:
the pole comprises at least one blade.

18. The pickup of claim 10, wherein:
the first assembly further comprises a top plate that sits over the base plate such that the pole extends at least into the top plate and the coil of wire is between the top plate and the base plate.

19. The pickup of claim 10 further comprising:
protective element over the coil of wire defined by a length of wire wrapped around the coil of wire.

* * * * *